US008118454B2

(12) United States Patent
Rains, Jr. et al.

(10) Patent No.: US 8,118,454 B2
(45) Date of Patent: Feb. 21, 2012

(54) SOLID STATE LIGHTING SYSTEM WITH OPTIC PROVIDING OCCLUDED REMOTE PHOSPHOR

(75) Inventors: Jack C. Rains, Jr., Herndon, VA (US); David P. Ramer, Reston, VA (US)

(73) Assignee: ABL IP Holding LLC, Conyers, GA (US)

( * ) Notice: Subject to any disclaimer, the term of this patent is extended or adjusted under 35 U.S.C. 154(b) by 0 days.

(21) Appl. No.: 12/629,618

(22) Filed: Dec. 2, 2009

(65) Prior Publication Data

US 2010/0259918 A1 Oct. 14, 2010

(51) Int. Cl.
*F21V 9/00* (2006.01)

(52) U.S. Cl. ..... 362/293; 362/231; 362/298

(58) Field of Classification Search ..... 362/84, 362/231, 293, 296.02, 296.04, 296.05, 298, 362/304, 306

See application file for complete search history.

(56) References Cited

U.S. PATENT DOCUMENTS

| | | | |
|---|---|---|---|
| 4,675,575 | A | 6/1987 | Smith et al. |
| 5,608,213 | A | 3/1997 | Pinkus et al. |
| 5,803,592 | A | 9/1998 | Lawson |
| 5,877,490 | A | 3/1999 | Ramer et al. |
| 5,914,487 | A | 6/1999 | Ramer et al. |
| 6,007,225 | A | 12/1999 | Ramer et al. |
| 6,222,623 | B1 | 4/2001 | Wetherell |
| 6,234,648 | B1 | 5/2001 | Borner et al. |
| 6,286,979 | B1 | 9/2001 | Ramer et al. |
| 6,357,889 | B1 | 3/2002 | Duggal et al. |
| 6,361,192 | B1 | 3/2002 | Fussell et al. |
| 6,422,718 | B1 | 7/2002 | Anderson et al. |
| 6,437,861 | B1 | 8/2002 | Kuta |
| 6,447,698 | B1 | 9/2002 | Ihara et al. |
| 6,473,554 | B1 | 10/2002 | Pelka et al. |
| 6,536,914 | B2 | 3/2003 | Hoelen et al. |
| 6,566,824 | B2 | 5/2003 | Panagotacos et al. |
| 6,692,136 | B2 | 2/2004 | Marshall et al. |
| 6,700,112 | B2 | 3/2004 | Brown |
| 6,737,681 | B2 | 5/2004 | Koda |
| 6,836,083 | B2 | 12/2004 | Mukai |
| 6,869,545 | B2 | 3/2005 | Peng et al. |
| 6,872,249 | B2 | 3/2005 | Peng et al. |
| 6,960,872 | B2 | 11/2005 | Beeson et al. |
| 6,969,843 | B1 | 11/2005 | Beach et al. |
| 6,985,163 | B2 | 1/2006 | Riddle et al. |

(Continued)

OTHER PUBLICATIONS

Pradhan, Narayan, et al., "An Alternative of CdSe Nanocrystal Emitters: Pure and Tunable Impurity Emissions in ZnSe Nanocrystals", Nov. 24, 2005, 127, pp. 17586-17587, J. A, Chem, Soc. Communications, web publication.

(Continued)

*Primary Examiner* — Y My Quach Lee
(74) *Attorney, Agent, or Firm* — McDermott Will & Emery LLP

(57) ABSTRACT

The present teachings relate to semiconductor-based lighting systems and fixtures which process electromagnetic energy from light emitting diodes or the like. A disclosed exemplary system includes at least one occluded remote phosphor and produces substantially white light of desired characteristics. The remote phosphor extends over at least a portion of a surface of a macro optic at an occluded location such that none of the remote phosphor is directly visible through an optical aperture. The phosphor is responsive to electromagnetic energy from a semiconductor device to emit visible light for the emission through the optical aperture.

19 Claims, 5 Drawing Sheets

U.S. PATENT DOCUMENTS

| | | | | |
|---|---|---|---|---|
| 6,995,355 | B2 | 2/2006 | Rains, Jr. et al. | |
| 7,025,464 | B2 | 4/2006 | Beeson et al. | |
| 7,040,774 | B2 | 5/2006 | Beeson et al. | |
| 7,102,152 | B2 | 9/2006 | Chua et al. | |
| 7,105,051 | B2 | 9/2006 | Peng et al. | |
| 7,144,131 | B2 | 12/2006 | Rains | |
| 7,148,632 | B2 | 12/2006 | Berman et al. | |
| 7,153,703 | B2 | 12/2006 | Peng et al. | |
| 7,160,525 | B1 | 1/2007 | Peng et al. | |
| 7,192,850 | B2 | 3/2007 | Chen et al. | |
| 7,220,039 | B2 | 5/2007 | Ahn et al. | |
| 7,235,190 | B1 | 6/2007 | Wilcoxon et al. | |
| 7,235,792 | B2 | 6/2007 | Elofson | |
| 7,273,904 | B2 | 9/2007 | Peng et al. | |
| 7,350,933 | B2 | 4/2008 | Ng et al. | |
| 7,374,807 | B2 | 5/2008 | Parce et al. | |
| 7,531,149 | B2 | 5/2009 | Peng et al. | |
| 7,560,677 | B2 | 7/2009 | Lyons et al. | |
| 7,665,865 | B1 * | 2/2010 | Hulse et al. | 362/293 |
| 7,768,192 | B2 | 8/2010 | Van De Ven et al. | |
| 2004/0135504 | A1 | 7/2004 | Tamaki et al. | |
| 2004/0151008 | A1 | 8/2004 | Artsyukhovich et al. | |
| 2004/0188594 | A1 | 9/2004 | Brown et al. | |
| 2005/0230673 | A1 | 10/2005 | Mueller et al. | |
| 2006/0072314 | A1 | 4/2006 | Rains | |
| 2007/0045524 | A1 | 3/2007 | Rains, Jr. et al. | |
| 2007/0051883 | A1 | 3/2007 | Rains, Jr. et al. | |
| 2007/0138978 | A1 | 6/2007 | Rains, Jr. et al. | |
| 2007/0170454 | A1 | 7/2007 | Andrews | |
| 2008/0030974 | A1 | 2/2008 | Abu-Ageel | |
| 2008/0094835 | A1 | 4/2008 | Marra et al. | |
| 2008/0106887 | A1 | 5/2008 | Salsbury et al. | |
| 2008/0117500 | A1 * | 5/2008 | Narendran et al. | 362/293 |
| 2008/0224025 | A1 | 9/2008 | Lyons et al. | |
| 2009/0003002 | A1 | 1/2009 | Sato | |
| 2009/0201677 | A1 * | 8/2009 | Hoelen et al. | 362/231 |
| 2009/0295266 | A1 | 12/2009 | Ramer et al. | |
| 2009/0296368 | A1 | 12/2009 | Ramer | |
| 2010/0165599 | A1 * | 7/2010 | Allen | 362/84 |
| 2010/0172120 | A1 * | 7/2010 | Wegh et al. | 362/84 |

OTHER PUBLICATIONS

"Energy Star Program Requirements for Solid State Lighting Luminaires Eligibility Criteria—Version 1.0", Manual, Sep. 12, 2007.

Yin, Yadong and A. Paul Alivisatos, "Colloidal nanocrystal sythesis and the organic-inorganic interface", Insight Review, Sep. 25, 2005, pp. 664-670, Nature vol. 437.

"Final Report: Highly Bright, Heavy Metal-Free, and Stable Doped Semiconductor Nanophosphors for Economical Solid State Lighting Alternatives", Report, Nov. 12, 2009, pp. 1-3, National Center for Environmental Research, web publication.

"Solid-State Lighting: Development of White LEDs Using Nanophosphor-InP Blends", Report, Oct. 26, 2009, p. 1, U.S. Department of Energy—Energy Efficiency and Renewable Energy, web publication.

"Solid-State Lighting: Improved Light Extraction Efficiencies of White pc-LEDs for SSL by Using Non-Toxic, Non-Scattering, Bright, and Stable Doped ZnSe Quantum Dot Nanophosphors (Phase I)", Report, Oct. 26, 2009,pp. 1-2, U.S. Department of Energy—Energy Efficiency and Renewable Energy, web publication.

"Chemistry—All in the Dope", Editor's Choice, Dec. 9, 2005, Science, vol. 310, p. 1, AAAS, web publication.

"D-dots: Heavy Metal Free Doped Semiconductor Nanocrystals", Technical Specifications, etc. Dec. 1, 2009, pp. 1-2, NN-LABS, LLC (Nanomaterials & Nanofabrication Laboratories), CdSe/ZnS Semiconductor Nanocrystals, web publication.

International Search Report and the Written Opinion of the International Searching Authority issued in International Application No. PCT/US2010/028150 dated May 17, 2010.

United States Office Action, issued in U.S. Appl. No. 13/237,626, dated Nov. 25, 2011.

* cited by examiner

SOLID STATE LIGHTING SYSTEM WITH OPTIC PROVIDING OCCLUDED REMOTE PHOSPHOR

TECHNICAL FIELD

The present subject matter relates to lighting systems and fixtures which process electromagnetic energy from light emitting diodes or the like using occluded remote phosphor and produce substantially white light of desired characteristics.

BACKGROUND

As costs of energy increase along with concerns about global warming due to consumption of fossil fuels to generate energy, there is an ever increasing need for more efficient lighting technologies. These demands, coupled with rapid improvements in semiconductors and related manufacturing technologies, are driving a trend in the lighting industry toward the use of light emitting diodes (LEDs) or other solid state light sources to produce light for general lighting applications, as replacements for incandescent lighting and eventually as replacements for other older less efficient light sources.

The actual solid state light sources, however, produce light of specific limited spectral characteristics. To obtain white light of a desired characteristic and/or other desirable light colors, one approach uses sources that produce light of two or more different colors or wavelengths and one or more optical processing elements to combine or mix the light of the various wavelengths to produce the desired characteristic in the output light. In recent years, techniques have also been developed to shift or enhance the characteristics of light generated by solid state sources using phosphors, including for generating white light using LEDs.

Phosphor based techniques for generating white light from LEDs, currently favored by LED manufacturers, include UV or Blue LED pumped phosphors or nano-phosphors. The phosphor materials may be provided as part of the LED package (on or in close proximity to the actual semiconductor chip), or the phosphor materials may be provided remotely (e.g. on or in association with a macro optical processing element such as a diffuser or reflector outside the LED package). The remote phosphor based solutions have advantages, for example, in that the color characteristics of the fixture output are more repeatable, whereas solutions using sets of different color LEDs and/or lighting systems with the phosphors inside the LED packages tend to vary somewhat in light output color from fixture to fixture, due to differences in the light output properties of different sets of LEDs (due to lax manufacturing tolerances of the LEDs).

Although these solid state lighting technologies have advanced considerably in recent years, there is still room for further improvement. For example, it is desirable in the lighting industry to provide lighting systems, which when installed, blend in or are neutral with their surrounding environments, such as ceilings, which are typically white in color. An installed lighting system is more visibly pleasing when its overall observed color is white or silver. However, when certain remote phosphor materials are used in lighting systems, they are often visible from outside of the fixture when not in use. Some phosphor materials for example, may have an undesirable salmon or yellowish color.

Hence a need exists for alternative techniques to effectively include a remote phosphor material in lighting systems and fixtures such that the remote phosphor is not directly visible through an optical aperture or the like, and still allow for the system or fixture to produce white light of high quality (e.g. desirable color rendering index and/or color temperatures).

SUMMARY

To address such needs entails extending remote phosphor over reflective materials, but in locations or configurations where none of the remote phosphor is directly visible through an optical aperture or the like of the lighting system.

For example, a lighting system for a visible light illumination application in a region or area to be inhabited by a person is provided. The lighting system includes a semiconductor device including a semiconductor chip for emitting electromagnetic energy and a package enclosing the semiconductor chip. A macro optic is outside and coupled to the package enclosing the semiconductor chip. The macro optic receives the electromagnetic energy emitted from the semiconductor device. At least one optical passage is provided for emission of light out of the optic to facilitate the visible light illumination application in the region or area to be inhabited by the person. The lighting system includes at least one remote phosphor being occluded and extending over at least a portion of a surface of the macro optic at a location such that none of the remote phosphor extending over the macro optic is directly visible through the optical aperture by the person. The at least one phosphor is responsive to electromagnetic energy from the semiconductor device to emit visible light for the emission through the at least one optical aperture.

In yet another example, a lighting system for a visible light illumination application in a region or area to be inhabited by a person is provided. The lighting system includes a plurality of semiconductor devices with each semiconductor device including a semiconductor chip for emitting electromagnetic energy and a package enclosing each semiconductor chip. A diffuse macro reflector is outside and coupled to the packages enclosing the semiconductor chips. The diffuse macro reflector forms an optical cavity and is configured to receive electromagnetic energy emitted from the plurality of semiconductor devices. At least one optical aperture is provided for emission of light out of the cavity to facilitate the visible light illumination application in the region or area to be inhabited by the person. A mask with a reflective surface is included for occluding a portion of the at least one optical aperture. At least one remote phosphor is occluded by way of the mask and extends over at least a portion of a surface of the diffuse macro reflector at a location such that none of the remote phosphor extends over the diffuse macro reflector is directly visible through the optical aperture by the person. The at least one phosphor is responsive to electromagnetic energy from the semiconductor device to emit visible light for the emission through the at least one optical aperture.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by practice or use of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

The various fixtures disclosed herein relate to applications of visible light for illumination for use/perception by humans. For example, a fixture may provide illumination of a room, space or area used or inhabited by a person. For a task lighting example, a fixture would provide light in the area, particularly on a work surface such as a desk or the like where the person performs the task. Other examples provide lighting in spaces such as walkways or stairs used by the person, or illuminate specific objects viewed by the person such as product displays or art works or the like. In addition to illumination applications, the lighting technologies discussed herein find wide use in illumination applications observable by persons.

Figure 1:
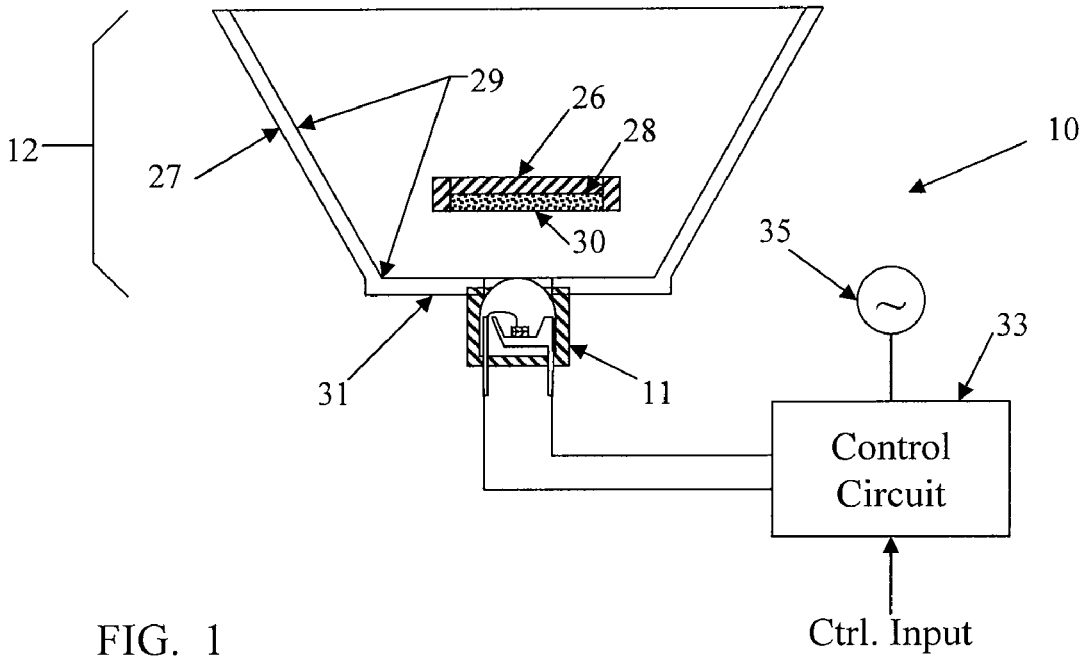
FIG. 1 illustrates an example of a white light emitting system where the remote phosphor is located on a reflective surface of a reflective mask in the optic, with certain elements of the fixture shown in cross-section.

Reference now is made in detail to the examples illustrated in the accompanying drawings and discussed below. FIG. 1 is a simplified illustration of a lighting system 10, for emitting visible, substantially white light, so as to be perceptible by a person. A fixture portion of the system is shown in cross-section (although some cross-hatching has been omitted for convenience). The circuit elements are shown in functional block form. The system 10 utilizes a solid state source 11, for emitting electromagnetic energy of a first wavelength. In a simple example of the type shown, the source 11 typically emits blue or white visible light or emits ultraviolet or near ultraviolet radiation. As shown in the other illustrated examples, there may be any number of solid state sources 11, as deemed appropriate to produce the desired level of output for the system 10 for any particular intended lighting application.

The solid state source 11 is a semiconductor based device for emitting electromagnetic energy. The structure includes a semiconductor chip, such as a light emitting diode (LED), a laser diode or the like, within a package or enclosure. A glass or plastic portion of the package that encloses the chip allows for emission of visible light or other electromagnetic energy from the chip in the desired direction. Many such source packages include internal reflectors to direct energy in the desired direction and reduce internal losses. To provide readers a full understanding, it may help to consider a simplified example of the structure of such a solid state source 11.

Figure 2:
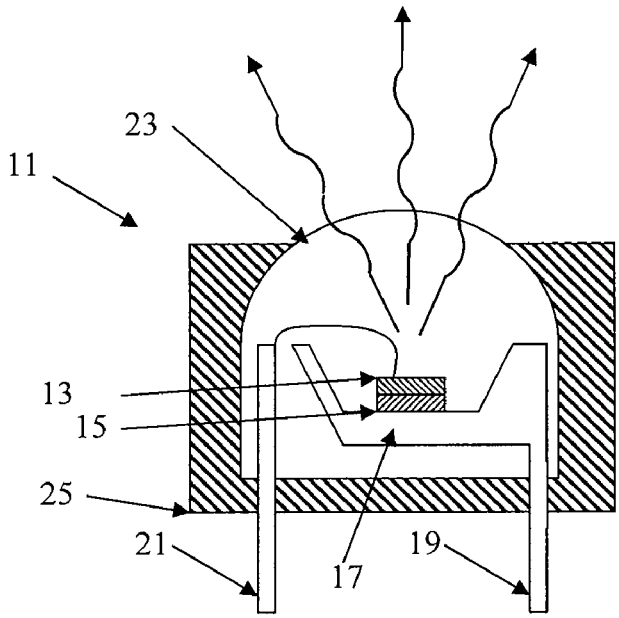
FIG. 2 is a simplified cross-sectional view of a light-emitting diode (LED) type semiconductor device.

FIG. 2 illustrates an example of an LED type solid state source 11, in cross section. In the example of FIG. 2, the source 11 includes a semiconductor chip, comprising two or more semiconductor layers 13, 15 forming the actual LED. The semiconductor layers 13, 15 forming the chip are mounted on an internal reflective cup 17 in this case, formed as an extension of a first electrode, e.g. the cathode 19. The cathode 19 and an anode 21 provide electrical connections to layers of the semiconductor device within the packaging for the source 11. An epoxy dome 23 (or similar transmissive part) of the enclosure allows for emission of the electromagnetic energy from the chip in the desired direction. In this simple example, the solid state source 11 also includes a housing 25 that completes the packaging/enclosure for the source. Typically, the housing 25 is metal, e.g. to provide good heat conductivity so as to facilitate dissipation of heat generated during operation of the LED. Internal "micro" reflectors, such as the reflective cup 17, direct energy in the desired direction and reduce internal losses. Although one or more elements in the package, such as the reflector 17 or dome 23 may be doped or coated with phosphor materials, phosphor doping integrated in (on or within) the package is not required the examples which utilize remote phosphor implementation.

Returning to FIG. 1, the system 10 utilizes a macro scale optic 12 together with the solid state source 11 to form a light fixture. The light fixture could be configured for a general lighting application. Examples of general lighting applications include downlighting, task lighting, "wall wash" lighting, emergency egress lighting, as well as illumination of an object or person in a region or area intended to be occupied by one or more people. A task lighting application, for example, typically requires a minimum of approximately 20 foot-candles (fcd) on the surface or level at which the task is to be performed, e.g. on a desktop or countertop. In a room, where the light fixture 1 is mounted in or hung from the ceiling or wall and oriented as a downlight, for example, the distance to the task surface or level can be 35 inches or more below the output of the light fixture. At that level, the light intensity will still be 20 fcd or higher for task lighting to be effective. Of course, the fixture (11, 12) of FIG. 1 may be used in other applications, such as vehicle headlamps, flashlights, etc.

The macro scale optical processing element or 'optic' 12 in this first example includes a macro (outside the packaging of source 11) scale reflector 27. The reflector 27 has a reflective surface 29 arranged to receive at least some electromagnetic energy from the solid state source 11. The disclosed system 10 may use a variety of different structures or arrangements for the reflector 27. For efficiency, the reflective surface 29 of the reflector 27 should be highly reflective. The reflective surface 29 may be specular, semi or quasi specular, or diffusely reflective.

In the example, the emitting region of the solid state source 11 fits into or extends through an aperture in a proximal section 31 of the reflector 27. The solid state source 11 may be coupled to the reflector 27 in any manner that is convenient and/or facilitates a particular lighting application of the system 10. For example, the source 11 may be within the volume of the reflector 27, the source may be outside of the reflector (e.g. above the reflector in the illustrated orientation) and facing to emit near UV light energy into the interior of the reflector, or the electromagnetic energy may be coupled from the solid source 11 to the reflector 27 via a light guide or pipe or by an optical fiber. However, close efficient coupling is preferable.

The lighting system 10 (or 10') also includes a control circuit 33 coupled to the LED type semiconductor chip in the source 11, for establishing output intensity of electromagnetic energy output of the LED source 11. The control circuit 33 typically includes a power supply circuit coupled to a voltage/current source, shown as an AC power source 35. Of course, batteries or other types of power sources may be used, and the control circuit 33 will provide the conversion of the source power to the voltage/current appropriate to the particular one or more LEDs 11 utilized in the system 10. The control circuit 33 includes one or more LED driver circuits for controlling the power applied to one or more source 11 and thus the intensity of energy output of the source and thus of the fixture. The control circuit 21 may be responsive to a number of different control input signals, for example to one or more user inputs as shown by the arrow in FIG. 1, to turn power ON/OFF and/or to set a desired intensity level for the white light output provided by the system 10.

The disclosed apparatus may use a variety of different structures or arrangements for the reflector 27. Although other reflectivities may be used, in the example, at least a substantial portion of the interior surface(s) 29 of the reflector 27 exhibit(s) a diffuse reflectivity. It is desirable that the reflective surface 29 have a highly efficient reflective characteristic, e.g. a reflectivity equal to or greater than 90%, with respect to the relevant visible wavelengths. In the example of FIG. 1, the surface 29 is highly diffusely reflective to energy in the visible, near-infrared, and ultraviolet wavelengths.

The diffuse reflector 27 and reflective surface 29 may be formed of a diffusely reflective plastic material, such as a polypropylene having a 97% reflectivity and a diffuse reflective characteristic. Such a highly reflective polypropylene, referred to as HRP-97, is available from Ferro Corporation—Specialty Plastics Group, Filled and Reinforced Plastics Division, in Evansville, Ind. Other exemplary materials offering approximately 97-98% reflectivity include WhiteOptics™ and Valar™. Another example of a material with a suitable reflectivity is SPECTRALON™, which approaches 99% reflectivity. Alternatively, the optical integrating cavity may comprise a rigid substrate (not separately shown) having an interior surface, and a diffusely reflective coating layer formed on the interior surface of the substrate so as to provide the diffusely reflective interior surface of the optical integrating cavity. The coating layer, for example, might take the form of a flat-white paint or white powder coat. A suitable paint might include a zinc-oxide based pigment, consisting essentially of an uncalcined zinc oxide and preferably containing a small amount of a dispersing agent. The pigment is mixed with an alkali metal silicate vehicle-binder which preferably is a potassium silicate, to form the coating material. For more information regarding the exemplary paint, attention is directed to U.S. Pat. No. 6,700,112 by Matthew Brown which issued on Mar. 2, 2004. Another example of an appropriate white coating material is Duraflect™.

Figure 4:
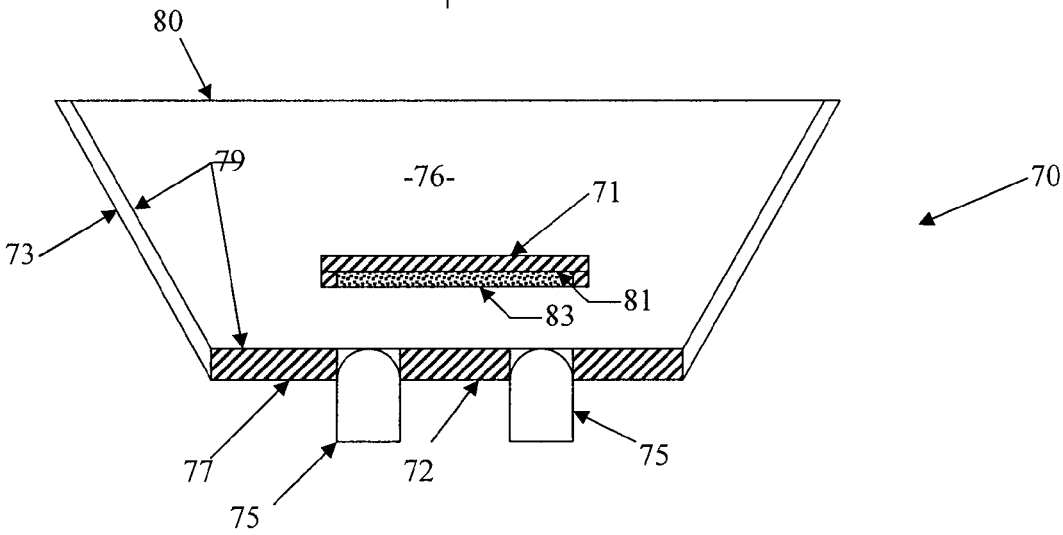
FIG. 4 illustrates an example of another white light emitting system, which uses a plurality of LED type sources and the remote phosphor is located on a reflective surface of a reflective mask in the optic, with certain elements of the fixture shown in cross-section.

System 10 utilizes a macro reflective mask 26 within the volume of the cavity, where the phosphor 30 is deployed remotely from the solid state source 11 on the surface of the reflective mask 26 facing toward the solid state sources 11. The remote phosphor 30 is occluded such that none of the phosphor is directly visible through the aperture. The edge of reflector 26 should cover edge of phosphor 30 such that occlusion is complete. For example, the phosphor 30 may not extend to the outer edges of the reflector 26, or the outer edges of the reflector 26 may be extended such that they cover the outer edges of the phosphor, as illustrated in FIGS. 1 and 4. In either example, occlusion is completed.

Phosphor is any of a number of substances that exhibit luminescence when struck by electromagnetic energy of certain wavelength(s). To provide desired color outputs, for example, it is increasingly common for the source packages to include phosphors at various locations to convert some of the chip output energy to more desirable wavelengths in the visible light spectrum. In the examples discussed herein, luminescent phosphor(s), in the form of one or more nano phosphors, are applied to or cover a surface of the reflector mask 26. In the examples, however, the reflector mask 26 is a macro device outside of or external to the package of the energy source 11, e.g. outside the enclosure 25 of the LED package 11 used to generate the electromagnetic energy. There need be no phosphors within the LED source package 11.

The lighting system 10 uses reflector mask 26, essentially a second macro reflector, positioned between the solid state source 11 and a region to be illuminated by the visible white light output from the system. The reflector mask 26 masks direct view solid state sources package and the remote phosphor 30 by any person in that region to be illuminated by the visible white light output from the system. In the illustrated example, the mask 26 is within the space or volume formed by the first reflector 27, but its position is not limited to the illustrated example. The base material used to form the reflector mask 26 may be any convenient one of the materials discussed herein for forming reflectors. The surface 28 facing toward the solid state source 11 is reflective. Although it may have other reflective characteristics, in the example, the surface 28 is diffusely reflective. At least a substantial portion of the area of the surface 28 facing toward the solid state source 11 is covered by a phosphor material 30 which is occluded by the mask 26.

At least some electromagnetic energy of the first wavelength, emitted from the energy source package 11, impacts on the reflective surface 28 and the phosphor coating 30. Excitation of the phosphor in the coating 30 causes it to emit visible light. The emitted light comprises visible light energy of at least one second wavelength different from the first wavelength. At least some of visible light emitted by the phosphor is reflected. The lighting system 10 directs at least the visible light from the phosphor so that it can be perceived by the person.

As outlined above, phosphors absorb excitation energy then re-emit the energy as radiation of a different wavelength than the initial excitation energy. For example, some phosphors produce a down-conversion referred to as a "Stokes shift," in which the emitted radiation has less quantum energy and thus a longer wavelength. Other phosphors produce an up-conversion or "Anti-Stokes shift," in which the emitted radiation has greater quantum energy and thus a shorter wavelength. Such energy shifts can be used to produce increased amounts of light in desirable portions of the spectrum. For example, by converting UV light to visible light, the shift increases system efficiency for visible illumination applications. The shift provided by the phosphors may also help to enhance the white light characteristics of the visible output, e.g. by conversion of some blue light emitted by a Blue or White LED.

A variety of conventional phosphors may be used. Recently developed quantum dot (Q-dot) phosphors or doped semiconductor nanophosphors may be used. Phosphors absorb excitation energy then re-emit the energy as radiation of a different wavelength than the initial excitation energy. For example, some phosphors produce a down-conversion referred to as a "Stokes shift," in which the emitted radiation has less quantum energy and thus a longer wavelength. Other phosphors produce an up-conversion or "Anti-Stokes shift," in which the emitted radiation has greater quantum energy and thus a shorter wavelength. Quantum dots (Q-dots) provide similar shifts in wavelengths of light. Quantum dots are nano scale semiconductor particles, typically crystalline in nature, which absorb light of one wavelength and re-emit light at a different wavelength, much like conventional phosphors. A Q-Dot product, applicable as an ink or paint, is available from QD Vision of Watertown Mass. However, unlike conventional phosphors, optical properties of the quantum dots can be more easily tailored, for example, as a function of the size of the dots. In this way, for example, it is possible to adjust the absorption spectrum and/or the emission spectrum of the quantum dots by controlling crystal formation during the manufacturing process so as to change the size of the quantum dots. Thus, quantum dots of the same material, but with different sizes, can absorb and/or emit light of different colors. For at least some exemplary quantum dot materials, the larger the dots, the redder the spectrum of re-emitted light; whereas smaller dots produce a bluer spectrum of re-emitted light. Doped semiconductor nanophosphors are similar to quantum dots but are also doped in a manner similar to doping of a semiconductor.

The phosphors may be provided in the form of an ink or paint. The phosphors can be carried in a binder or other medium in a solid, gel or liquid form. The medium preferably is highly transparent (high transmissivity and/or low absorption to light of the relevant wavelengths). Alcohol, vegetable oil, silicon or other media may be used. If silicone is used, it may be in gel form or cured into a hardened form in the finished light fixture product. Examples of suitable materials, having the phosphor(s) in a silicone medium, are available from NN Labs of Fayetteville, Ark.

In one system incorporating one or more blue LEDs (center frequency of 460 nm) as the source 11, the phosphors in the reflector mask 26 may be from the green-yellow $Ce^{3+}$ doped garnet family (e.g. $(Y, Gd)_3AL_5O_{12}$). An alternative approach that results in even better color generation and white light of any color temperature adds green and red phosphors (e.g., $SrGa_2S_4:Eu^{2+}$ and $SrS:Eu^{2+}$). As light from the blue LEDs is mixed in the optical system formed by the reflector mask 26, the phosphors are excited and emit light over a broad spectrum that when added in the optical chamber or space formed by the reflector mask 26 allows for the creation of extremely high quality (e.g., desirable CRI and color temperature) white light.

At least some nano-phosphors degrade in the presence of oxygen, reducing the useful life of the nano-phosphors. Hence, it may be desirable to encapsulate the nano-phosphor material in a manner that blocks out oxygen, to prolong useful life of the nano-phosphor. The container can be a sealed glass container, the material of which is highly transmissive and exhibits a low absorption with respect to visible light and the relevant wavelength(s) of near UV energy. The interior of the container is filled with the nano-phosphor material in a manner that leaves little or no gas within the interior of the container. Any of a number of various sealing arrangements may be used to seal the interior once filled, so as to maintain a good oxygen barrier and thereby shield the nano-phosphors from oxygen. Exemplary phosphor containers are described in co-pending U.S. patent application Ser. No. 12/434,248, which was filed on May 1, 2009, entitled Heat Sinking And Flexible Circuit Board, For Solid State Light Fixture Utilizing An Optical Cavity, the disclosure of which is incorporated herein by reference in its entirety.

If one or more UV LEDs are used as the source 11, a blue phosphor (e.g., $Sr_2P_2O_7$), is added to the reflective material in addition to the green and red phosphors. Excitation of the various phosphors by the UV energy from the LED(s) produces blue, red and green light over a broad spectrum. The phosphor emissions are combined in the optical system formed by the reflector mask 26 to produce extremely high quality (e.g., desirable CRI and color temperature) white light.

In the system 10 of FIG. 1, with a single LED source package 11, the phosphor or phosphors in the reflector mask 26 would be excited by wavelength of energy at or about the rated wavelength output of that source. Where the system includes sources of multiple types, e.g. one or more UV LEDs in combination with one or more Blue or White LEDs, phosphors may be selected of different types excitable by the different wavelengths of the input energy from the sources.

There are many available phosphor options, primarily based on oxidic or sulfidic host lattices. Additional host materials are becoming available, e.g., those based on a solid solution of silicon nitride ($Mx(Si,Al)_{12}(N,O)_{16}$, where M is a solid solution metal such as Eu (or other optically active rare earth ions). Future phosphor formulations include nanophosphors based upon quantum dots, currently under development by DOE's Sandia National Laboratory.

Remote deployment enables the system 10 to utilize much more phosphor material than could be provided within the relatively small LED type source package 11. As a result, the phosphor emissions do not degrade from usage as rapidly. Also, it is possible to provide adequate amounts of phosphors of a wider variety Remote phosphor material also enables a combination of approaches to be used when Red, Green, and Blue LEDs are combined with UV LEDs into the optical chamber. Thus the visible output of the RGB LEDs, augmented by the additional light generated by Blue and/or UV LED-pumped phosphors.

The present concepts presented herein entail extending remote phosphor over reflective materials, but only in locations or configurations where none of the remote phosphor is directly visible through an optical aperture or the like of the lighting system. As such, an installed lighting system will be more visibly pleasing because its overall observed color is white or silver due to the complete occlusion of the remote phosphor. Thus, in cases when certain phosphor material that have an undesirable salmon or yellowish color are used in the lighting system, they can be completely occluded and not directly visible through an optical aperture or the like of the lighting system, thereby preserving the visibly pleasing character of the lighting system.

The system 10 of FIG. 1 may include additional optical processing elements, for processing of the white light emissions. Examples include deflectors of various shapes and reflective characteristics, lenses, additional masks, collimators, focusing systems, irises, diffusers, holographic diffusers and the like located in, over or otherwise coupled to an aperture(s). To help fully understand, it may be useful to consider a first example, using a deflector having an inner reflective surface coupled to the aperture, to direct the light emissions from the aperture to a desired field of illumination. Such an example is described below.

Figure 3A:
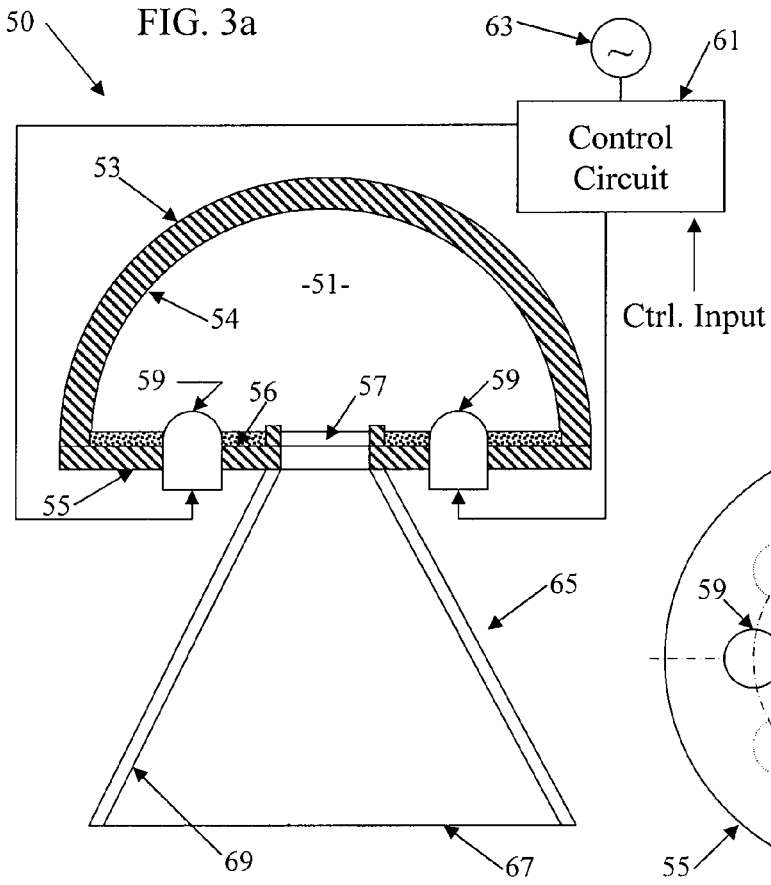
FIG. 3*a* illustrates an example of a white light emitting system, which utilizes a plurality of LED type sources and uses an optical integrating cavity and a deflector as parts of the optic, with certain elements thereof shown in cross-section.

FIG. 3*a* is a cross-sectional illustration of electromagnetic energy distribution system 50. For task lighting applications, the system 50 emits light in the visible spectrum, although the system 50 may be used for illumination applications. The illustrated system 50 includes an optical cavity 51 having a diffusely reflective interior surface to receive and combine electromagnetic energy of different reflective colors/wavelengths.

The cavity 51 effectively combines or 'integrates' the energy of the different wavelengths, so that the electromagnetic energy emitted through the optical aperture 57 includes the electromagnetic energy of the various wavelengths. Of note for purposes of visible light applications, the combined light includes visible light (if any) emitted from the sources 59 and diffusely reflected from the surface 54, some visible light emitted by the phosphor coating/covering of surface 56 and emerging through the aperture 57, as well as visible light emitted by the phosphor that is diffusely reflected by other parts before emerging through the aperture 57. The wavelengths produced by the emissions differ from and supplement the wavelengths emitted by the sources 59. By combining these various wavelengths, it is possible to combine visible light colors to produce a desired quality (e.g. desirable color render index or "CRI") of white light emissions of the system 50 through the optical aperture 57. The cavity 51 may have various shapes. The illustrated cross-section would be substantially the same if the cavity is hemispherical or if the cavity is semi-cylindrical with the cross-section taken perpendicular to the longitudinal axis. The optical cavity 51 in the example discussed below is typically an optical integrating cavity.

Figure 3B:
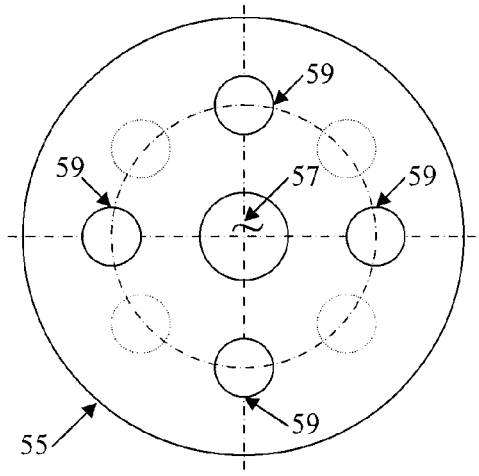
FIG. 3*b* is an interior view of the LEDs and aperture of the system of FIG. 3*a*.

At least a substantial portion of the interior surface(s) of the cavity 51 exhibit(s) diffuse reflectivity. It is desirable that the cavity surface have a highly efficient reflective characteristic, e.g. a reflectivity equal to or greater than 90%, with respect to the relevant wavelengths. In the example of FIGS. 3*a* and 3*b*, the surface is highly diffusely reflective to energy in the visible, near-infrared, and ultraviolet wavelengths.

For purposes of the discussion, the cavity 51 in the apparatus 50 is assumed to be hemispherical. In the example, a hemispherical dome 53 and a substantially flat cover plate 55 form the optical cavity 51. Although shown as separate elements, the dome and plate may be formed as an integral unit. At least the interior facing surface 54 of the dome 53 and the interior facing surface 56 of the cover plate 55 are highly diffusely reflective, so that the resulting cavity 51 is highly diffusely reflective with respect to the electromagnetic energy spectrum produced by the system 50. As a result the cavity 51 is an integrating type optical cavity. The materials forming the inner surface 56, are applied with one or more remote phosphors, so that the impact of some of the energy on the surfaces causes emission of visible light of additional desired color(s). Portions of cover plate 55 cover the ends of inner surfaces 56 near the aperture 57 such that complete occlusion is obtained.

Elements of the reflector forming the cavity 51 (e.g. consisting of dome 53 and plate 55) may be formed of a diffusely reflective plastic material, such as a polypropylene having a 97% reflectivity and a diffuse reflective characteristic. Such a highly reflective polypropylene, referred to as HRP-97, is available from Ferro Corporation—Specialty Plastics Group, Filled and Reinforced Plastics Division, in Evansville, Ind. Another example of a material with a suitable reflectivity is SPECTRALON™. Alternatively, one or more of the elements forming the optical integrating cavity 51 may comprise a rigid substrate having an interior surface, and a diffusely reflective coating layer formed on the interior surface of the substrate so as to provide the diffusely reflective interior surface 54 or 56 of the optical integrating cavity 51. The coating layer, for example, might take the form of a flat-white paint or white powder coat. A suitable paint might include a zinc-oxide based pigment, consisting essentially of an uncalcined zinc oxide and preferably containing a small amount of a dispersing agent. The pigment is mixed with an alkali metal silicate vehicle-binder which preferably is a potassium silicate, to form the coating material. For more information regarding the exemplary paint, attention is directed to U.S. Pat. No. 6,700,112 by Matthew Brown which issued on Mar. 2, 2004.

The materials forming the reflective surface 56 are applied with at least one remote phosphor not directly visible through aperture 57. As a result the structure appears layered in cross-section due to coating of a substrate. The specific phosphor used will be similar to those discussed above, and one or more phosphors are selected to convert portions of the energy from the sources 59 to the desired spectrum for color combination and output as white light.

The optical integrating cavity 51 has optical aperture 57 for allowing emission of combined electromagnetic energy. In the example, the aperture 57 is a passage through the approximate center of the cover plate 55, although the aperture may be at any other convenient location on the plate 55 or the dome 53. There may be a plurality of apertures, for example, oriented to allow emission of integrated light in two or more different directions or regions.

Because of the diffuse reflectivity within the cavity 51, light within the cavity is integrated before passage out of the optical aperture 57. In the examples, the system 50 is shown emitting the combined electromagnetic energy downward through the aperture, for convenience. However, the system 50 may be oriented in any desired direction to perform a desired application function, for example to illuminate a different surface such as a wall, floor or table top.

The system 50 also includes a plurality of sources of electromagnetic energy. As will be discussed below, the sources may provide a single color or wavelength of energy, e.g. UV energy, or the sources may provide energy of different wavelengths. Although other semiconductor devices may be used, in this example, the sources are LEDs 59, three of which are visible in the illustrated cross-section. The LEDs are generally similar to the LED package 11 of FIG. 2. The LEDs 59 supply electromagnetic energy into the interior of the optical integrating cavity 51. As shown, the points of emission into the interior of the optical integrating cavity are not directly visible through the optical aperture 57.

The system 50 of FIGS. 3*a* and 3*b* may utilize various combinations of LEDs producing UV or various combinations of visible light, for integration in the cavity 51. For purposes of discussion, the system 50 combines Red, Green, and Blue LEDs with one or more UV LEDs coupled to emit energy into the optical chamber 51. As shown in the interior view of FIG. 3*b*, there are four LED packages 59, one Red (R), one Green (G), one Blue (B) and one Ultraviolet (UV) or near UV LED arranged substantially in a circle around the aperture 57 through the cover plate 55. Of course there may be additional LED packages coupled through openings in the plate, as represented by the dotted line circles. LEDs also may be provided at or coupled to other points on the plate or dome.

The Red (R) and Green (G) LEDs are fully visible in the illustrated cross-section of 3*a*, and the dome of the UV LED package is visible as it extends into the cavity 51. Assuming four LEDs only for simplicity, the Blue LED is not visible in this cross-section view. It should be apparent, however, that the system 50 uses the visible output of the RGB LEDs, augmented by the additional light generated by UV or near UV LED-pumped phosphors.

In this example, light outputs of the LED sources 59 are coupled directly to openings at points on the interior of the cavity 51, to emit electromagnetic energy directly into the interior of the optical integrating cavity 51. The LEDs 59 may be located to emit light at points on the interior wall of the element 53 (see for example FIGS. 8 and 9), although such points would still be in regions out of the direct line of sight through the optical aperture 57 either by their position away from the aperture or due to masking by a reflector mask. For ease of construction, however, the openings for the LEDs 59 are formed through the cover plate 55. On the plate 55, the openings/LEDs may be at any convenient locations. Of course, the LED packages or other sources may be coupled to the points for entry into the cavity 51 in any other manner that is convenient and/or facilitates a particular illumination application of the system 50. For example, one or more of the sources 59 may be within the volume of the cavity 51. As another example, the sources 59 may be coupled to the openings into the cavity 51 via a light guide or pipe or by an optical fiber.

The source LEDs 59 can include LEDs of any color or wavelength, although one or more LEDs are chosen specifically to emit energy that excites the phosphor applied to reflective surface 56. The integrating or mixing capability of the cavity 51 serves to project white or substantially white light through the aperture 57. By adjusting the intensity of the various sources 59 coupled to the cavity, it becomes possible to precisely adjust the color temperature or color rendering index of the light output.

The system 50 works with the totality of light output from a family of LEDs 59 and light output from the phosphor. However, to provide color adjustment or variability, it is not necessary to control the output of individual LEDs, except as they contribute to the totality. For example, it is not necessary to modulate the LED outputs. Also, the distribution pattern of the individual LEDs 59 and their emission points into the cavity 51 are not significant. The LEDs 59 can be arranged in any convenient or efficient manner to supply electromagnetic energy within the cavity 51, although direct view of the LEDs from outside the fixture is minimized or avoided.

The apparatus 50 also includes a control circuit 61 coupled to the LEDs 59 for establishing output intensity of electromagnetic energy of each of the LED sources. The control circuit 61 typically includes a power supply circuit coupled to a source, shown as an AC power source 63, although those skilled in the art will recognize that batteries or other power sources may be used. In its simplest form, the circuit 61 includes a common driver circuit to convert power from source 63 to the voltages/current appropriate to drive the LEDs 59 at an output intensity specified by a control input to the circuit 61. The control input may be indicate an ON/OFF state and/or provide a variable intensity control.

It is also contemplated that the LEDs may be separately controlled, to allow control of the color temperature or color rendering index of the white light output. In such an implementation, the control circuit 61 includes an appropriate number of LED driver circuits for controlling the power applied to each of the individual LEDs 59 (or to each of a number of groups of LEDs, where each group emits energy of the same wavelength). These driver circuits enable separate control of the intensity of electromagnetic energy supplied to the cavity 51 for each different wavelength. Control of the intensity of emission of the sources sets a spectral characteristic of the electromagnetic energy supplied into the cavity 51 and thus the components that drive the phosphor emissions and/or supply visible light for integration within the cavity and thus for emission through the aperture 57 of the optical integrating cavity. The control circuit 61 may be responsive to a number of different control input signals, for example, to one or more user inputs as shown by the arrow in FIG. 3*a*. Although not shown in this simple example, feedback may also be provided. Those skilled in the art will be familiar with the types of control circuits that may be used, for example, to provide user controls and/or a variety of desirable automated control functions. A number of such circuits as well as various shapes and configurations of the cavity, the deflector and various alternative output processing elements are disclosed in commonly assigned U.S. Pat. No. 6,995,355 which issued on Feb. 7, 2006, and the disclosure thereof from that patent is incorporated herein entirely by reference.

The optical aperture 57 may serve as the system output, directing integrated color light to a desired area or region to be illuminated. Although not shown in this example, the aperture 57 may have a grate, lens or diffuser (e.g. a holographic element) to help distribute the output light and/or to close the aperture against entry of moisture or debris. For some applications, the system 50 includes an additional deflector or other optical processing element, e.g. to distribute and/or limit the light output to a desired field of illumination.

In the example of FIG. 3*a*, the color integrating energy distribution apparatus also utilizes a conical deflector 65 having a reflective inner surface 69, to efficiently direct most of the light emerging from a light source into a relatively narrow field of view. A small opening at a proximal end of the deflector is coupled to the aperture 57 of the optical integrating cavity 51. The deflector 65 has a larger opening 67 at a distal end thereof. The angle and distal opening of the conical deflector 65 define an angular field of electromagnetic energy emission from the apparatus 50. Although not shown, the large opening of the deflector may be covered with a transparent plate or a lens or a diffuser, or covered with a grating, to prevent entry of dirt or debris through the cone into the system and/or to further process the output electromagnetic energy.

The conical deflector 65 may have a variety of different shapes, depending on the particular lighting application. In the example, where cavity 51 is hemispherical, the cross-section of the conical deflector is typically circular. However, the deflector may be somewhat oval in shape. In applications using a semi-cylindrical cavity, the deflector may be elongated or even rectangular in cross-section. The shape of the aperture 57 also may vary, but will typically match the shape of the small end opening of the deflector 65. Hence, in the example the aperture 57 would be circular. However, for a device with a semi-cylindrical cavity and a deflector with a rectangular cross-section, the aperture may be rectangular.

The deflector 65 comprises a reflective interior surface 69 between the distal end and the proximal end. In some examples, at least a substantial portion of the reflective interior surface 69 of the conical deflector exhibits specular reflectivity with respect to the integrated electromagnetic energy. As discussed in U.S. Pat. No. 6,007,625, for some applications, it may be desirable to construct the deflector 65 so that at least some portions of the inner surface 69 exhibit diffuse reflectivity or exhibit a different degree of specular reflectivity (e.g. quasi-specular), so as to tailor the performance of the deflector 65 to the particular application.

For other applications, it may also be desirable for the entire interior surface 69 of the deflector 65 to have a diffuse reflective characteristic. In such cases, the deflector 65 may be constructed using materials similar to those taught above for construction of the optical integrating cavity 51. Hence, in the example of FIG. 3*a*, the deflector has a surface layer 69 which forms a diffusely reflective inner surface.

In the illustrated example, the large distal opening 67 of the deflector 65 is roughly the same size as the cavity 51. In some applications, this size relationship may be convenient for construction purposes. However, a direct relationship in size of the distal end of the deflector and the cavity is not required. The large end of the deflector may be larger or smaller than the cavity structure. As a practical matter, the size of the cavity 51 is optimized to provide the integration or combination of light colors from the desired number of LED sources 59 and the phosphor generating light within the cavity 51. The size, angle and shape of the deflector 65 in turn determine the area that will be illuminated by the combined or integrated light emitted from the cavity 51 via the aperture 57.

An exemplary system 50 may also include a number of "sleeper" LEDs (for example at the dotted line positions shown in FIG. 3*b*) that would be activated only when needed, for example, to maintain the light output, color, color temperature, or thermal temperature. As noted above, a number of different examples of control circuits may be used. In one example, the control circuitry comprises a color sensor coupled to detect color distribution in the integrated electromagnetic energy. Associated logic circuitry, responsive to the detected color distribution, controls the output intensity of the various LEDs, so as to provide a desired color distribution in the integrated electromagnetic energy. In an example using sleeper LEDs, the logic circuitry is responsive to the detected color distribution to selectively activate the inactive light emitting diodes as needed, to maintain the desired color distribution in the integrated electromagnetic energy. As LEDs age or experience increases in thermal temperature, they continue to operate, but at a reduced output level. The use of the sleeper LEDs greatly extends the lifecycle of the fixtures. Activating a sleeper (previously inactive) LED, for example, provides compensation for the decrease in output of an originally active LED. There is also more flexibility in the range of intensities that the fixtures may provide.

To provide a particular desirable output distribution from the apparatus, it is also possible to construct the system so as to utilize principles of constructive occlusion. Constructive Occlusion type transducer systems utilize an electrical/optical transducer optically coupled to an active area of the system, typically the aperture of a cavity or an effective aperture formed by a reflection of the cavity. Constructive occlusion type systems utilize diffusely reflective surfaces, such that the active area exhibits a substantially Lambertian characteristic. A mask occludes a portion of the active area of the system, in the examples, the aperture of the cavity or the effective aperture formed by the cavity reflection, in such a manner as to achieve a desired response or output characteristic for the system. In examples of the present apparatus using constructive occlusion, an optical integrating cavity might include a base, a mask and a cavity formed in the base or the mask. The mask would have a reflective surface. The mask is sized and positioned relative to the active area of the system so as to constructively occlude the active area. At least one of the reflective areas is applied with phosphors, to provide the desired white light generation from the energy supplied by the energy source package. To fully understand applications utilizing constructive occlusion, it may be helpful at this point to consider some representative examples.

Figure 5:
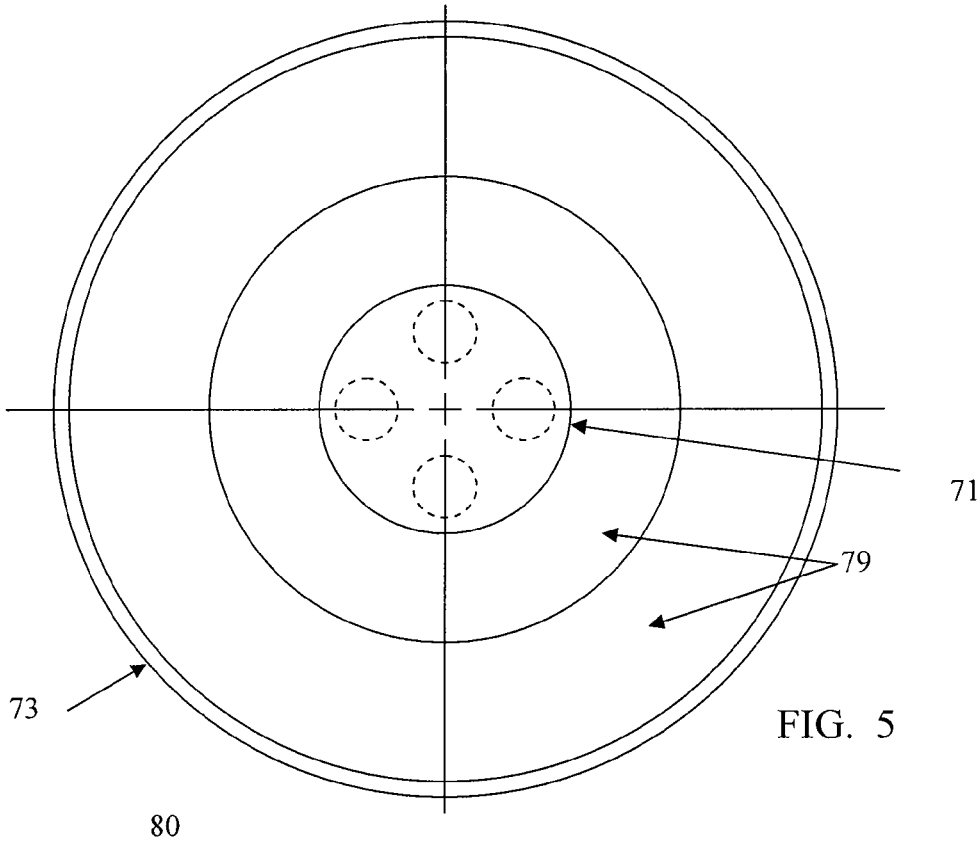
FIG. 5 is a top view of the fixture used in the system of FIG. 4.

FIGS. 4 and 5 are cross-section and top views of an example of a system 70 that utilizes a reflective mask 71 within the volume of a macro reflector 73, where the phosphor is deployed remotely from the solid state sources on the surface of the reflective mask 71 facing toward the solid state sources 75. FIG. 4 illustrates a plurality of solid state sources. The remote phosphor is occluded such that none of the phosphor is directly visible through the aperture 80. As with the earlier example, the directional orientation is given only by way of an example that is convenient for illustration and discussion purposes.

The system 70 may include one energy source package as in the example of FIG. 1, for emitting radiant energy of the first wavelength. In the illustrated example of FIGS. 4 and 5, the system 70 includes a plurality (e.g. four) energy sources 75, at least one of which emits the energy of the first wavelength. Typically, one of the sources 75 emits blue or white, ultraviolet or near ultraviolet radiation, although others of the sources may emit visible light of different wavelengths. For discussion purposes, it is assumed that the sources 75 are LEDs, one of which is a UV or near UV LED, one is Green, one is Red and one is Blue. Except for the wavelength or color of the energy produced, each source 75 is generally similar and of the general type discussed above, although other semiconductor devices may be used.

The system 110 utilizes a reflector 73, located outside the energy source packages 75. The reflector 73 has a reflective surface 79 arranged to receive at least some radiant energy from the energy source packages 75. In the example, the emitting region of each source 75 fits into or extends through an aperture in a back section 77 of the reflector 73. The sources 75 may be coupled to the reflector 73 in any manner that is convenient and/or facilitates a particular illumination or luminance application of the system 70, as discussed above. The reflector 73 has a reflective inner surface 79, which may be diffusely reflective, specular or quasi-specular, as in the example of FIG. 1.

The lighting system 70 uses a mask 71, essentially a second macro reflector, positioned between the solid state sources 75 and a region to be illuminated by the visible white light output from the system. The reflector mask 71 masks direct view solid state sources package and the remote phosphor by any person in that region. In the illustrated example, the mask 71 is within the space or volume formed by the first reflector 73, but is not limited to this specific location. The base material used to form the mask reflector 71 may be any convenient one of the materials discussed herein for forming reflectors. The surface 81 facing toward the solid state sources 75 is reflective. Although it may have other reflective characteristics, in the example, the surface 81 is diffusely reflective. At least a substantial portion of the area of the surface 81 facing toward the solid state sources 75 is covered by a phosphor material 83 which is occluded by the mask 71. The remote phosphor material is shown as a surface coating analogous to the coating the example of FIG. 3A. Although not shown in this example, the reflective surface(s) 72 between the solid state sources 75 may be applied with one or more remote phosphors which will be not be visible through aperture 80 due to the presence of reflector mask 71. The system 70 utilizes energy source packages 75, for emitting electromagnetic energy of a first wavelength into the cavity.

The system 70 includes a control circuit 61 and power source 63, similar to those in several of the earlier examples. These elements control the operation and output intensity of each LED 75. The intensities determine the amount of light energy introduced into the space between the reflectors 71 and 77. The intensities of that light that pumps the phosphor in the coating 83 also determine the amount visible light generated by the excitation of the phosphor. Visible light generated by the phosphor excitation reflects one of more times from the surfaces of the reflectors 71 and 77 and is emitted from the distal end of the reflector.

The solid state sources in any of the fixtures discussed above may be driven by any known or available circuitry that is sufficient to provide adequate power to drive the semiconductor devices therein at the level or levels appropriate to the particular general lighting application of each particular fixture. Analog and digital circuits for controlling operations and driving the emitters are contemplated, and power may be derived from DC or AC sources. Those skilled in the art should be familiar with various suitable circuits For many white light applications, the control circuitry may offer relatively simple user control, e.g. just ON/OFF or possibly with some rudimentary dimmer functionality.

Figure 6:
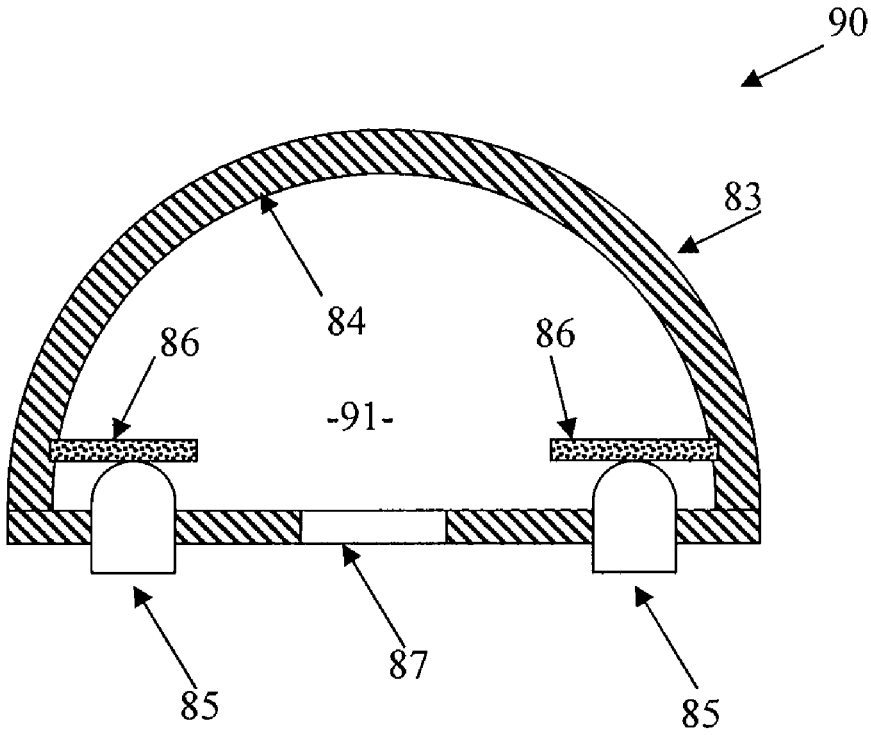
FIG. 6. illustrates an example of another white light emitting system, with certain elements thereof shown in cross-section.
Figure 7:
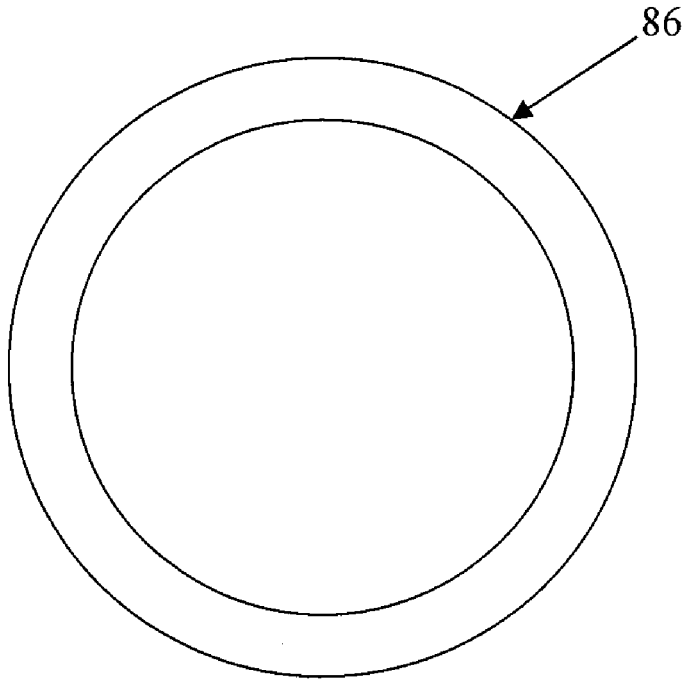
FIG. 7 illustrates an example of a ring-shaped phosphor material used in the system of FIG. 6.

FIG. 6 is yet another example of a white light emitting system. The system 90 of FIG. 6 may utilize various combinations of LEDs producing UV or various combinations of visible light, for integration in the cavity 91. There are a plurality of LED packages 85 arranged substantially in a circle around the aperture 87. The source LEDs 85 can include LEDs of any color or wavelength, although one or more LEDs are chosen specifically to excite the applied phosphor coating on diffusely reflective surface 86 which covers a portion of a surface of the LED sources 85. Reflective surface 86 is a ring-shaped reflective material with an applied phosphor coating and is positioned in the cavity and is illustrated in FIG. 7.

In the example, a dome 83 and a substantially flat cover plate (not shown) form the optical cavity 91. The dome 83 and plate may be formed as an integral unit or separate units. At least the interior facing surface 84 of the dome 83 and the reflective surface 86 are highly diffusely reflective, so that the resulting cavity 91 is highly diffusely reflective with respect to the electromagnetic energy spectrum produced by the system 90. As a result the cavity 91 is an integrating type optical cavity. The material forming the ring shaped reflective surface 86, is applied with a coating containing one or more remote phosphor, so that the impact of some of the energy on the surfaces causes emission of visible light of additional desired color(s). The integrating or mixing capability of the cavity 91 serves to project white or substantially white light through the aperture 87. By adjusting the intensity of the various sources 85 coupled to the cavity, it becomes possible to precisely adjust the color temperature or color rendering index of the light output.

The system 90 works with the totality of light output from a family of LEDs 85 and light output from the phosphor. Direct view of the LEDs 85 from outside the fixture is avoided. Although not shown, the system 90 also includes a control circuit and power source coupled to the LEDs 85 for establishing output intensity of electromagnetic energy of each of the LED sources. Examples of a control circuit and a power source are discussed herein.

The optical aperture 87 may serve as the system output, directing integrated color light to a desired area or region to be illuminated. Although not shown in this example, the aperture 87 may have a grate, lens or diffuser (e.g. a holographic element) to help distribute the output light and/or to close the aperture against entry of moisture or debris. For some applications, the system 90 includes an additional deflector or other optical processing element, e.g. to distribute and/or limit the light output to a desired field of illumination.

Figure 8:
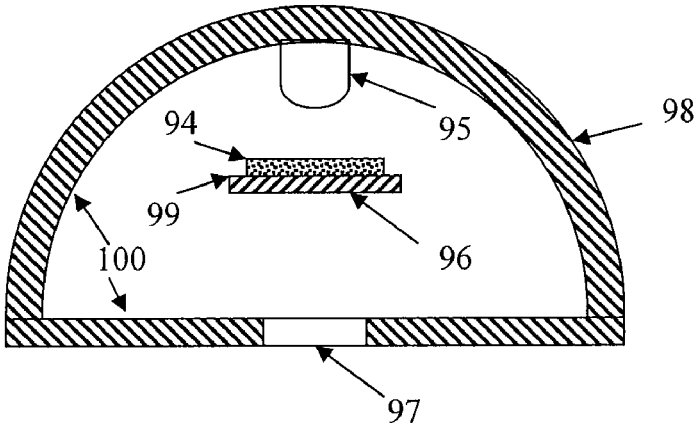
FIG. 8 illustrates an example of yet another white light emitting system, with certain elements thereof shown in cross-section.

In the example illustrated in FIG. 8, the position the solid state source 95 is in the wall of dome 98 and is occluded from aperture 97 by way of reflective mask 96. The lighting system uses a reflector forming a mask 96, positioned between the solid state source 95 and aperture 97. The reflector 96 masks direct view of solid state source 95 and the remote phosphor 94 by any person in the region to be illuminated by the visible white light output from the system. The reflector mask 96 is within the space or volume formed by the first reflector 98. At least a substantial portion of the area of surface 99 facing toward the solid state source 95 is covered by phosphor material 94 which is occluded by the reflector mask 96. The remote phosphor material 94 is shown as a surface coating not extending to the outer edges of the reflector mask. Surface 100 is reflective and although it may have other reflective characteristics, in the example, the surface 100 is diffusely reflective.

FIG. 8 is a simplified diagram illustrating a constructive occlusion type implementation of a lighting system. The system in FIG. 8 includes a control circuit and power source (not shown), similar to those in several of the earlier examples. These elements control the operation and output intensity of each solid state source 95. The intensities determine the amount of light energy introduced into the space between the reflectors 100 and 96. The intensities of that light that pumps the phosphor in the coating 94 also determine the amount visible light generated by the excitation of the phosphor. Visible light generated by the phosphor excitation reflects one or more times from the surfaces of the reflectors 100 and 96 before being emitted.

Figure 9:
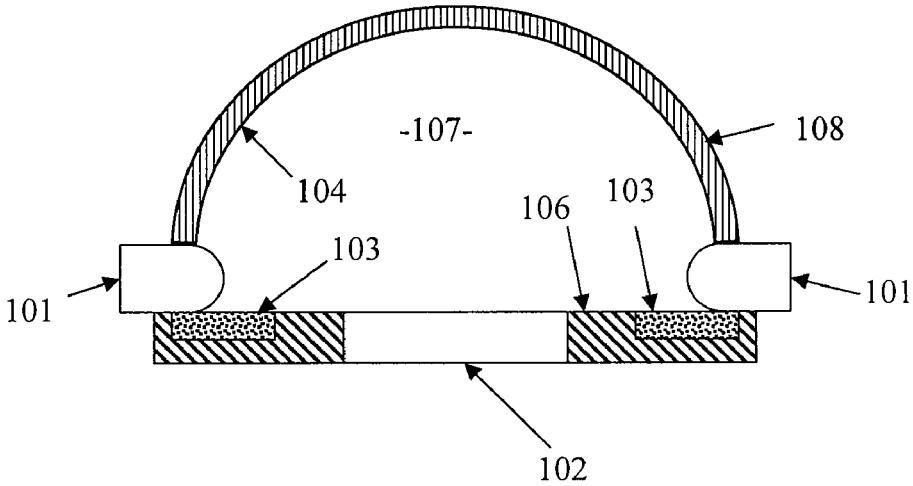
FIG. 9 illustrates an example of yet another white light emitting system, with certain elements thereof shown in cross-section.

FIG. 9 is a simplified diagram illustrating a constructive occlusion type implementation of a lighting system. The system in FIG. 9 includes a control circuit and power source (not shown), similar to those in several of the earlier examples. These elements control the operation and output intensity of each solid state sources 101. The intensities determine the amount of light energy introduced into cavity 107.

The intensities of light that pumps the phosphor in the coating 103 also determine the amount visible light generated by the excitation of the phosphor. The solid state sources 101 and phosphor material 103 are not directly visible through the optical aperture 102 due to their positioning away from aperture 102. Visible light generated by the phosphor excitation reflects one or more times before being emitted.

In the example, a hemispherical dome 108 and a substantially flat cover plate 106 form the optical cavity 107. The dome and plate may be formed as an integral unit or separately. At least the interior facing surface 104 of the dome 108 and the interior facing surface 103 of the cover plate are highly diffusely reflective, so that the resulting cavity 107 is highly diffusely reflective with respect to the electromagnetic energy spectrum produced by the system. As a result the cavity 107 is an integrating type optical cavity. The material forming the inner surface 103, is applied as a coating on a surface of flat cover plate 106, with the coating containing one or more remote phosphors, so that the impact of some of the energy on the surfaces causes emission of visible light of additional desired color(s). At least some electromagnetic energy of the first wavelength, emitted from the energy source packages 101, impacts on the reflective surfaces 104, 106 and the phosphor coating 103. Excitation of the phosphor in the coating 103 causes it to emit visible light. The emitted light comprises visible light energy of at least one second wavelength different from the first wavelength. At least some of visible light emitted by the phosphor is reflected. The lighting system in FIG. 9 directs at least the visible light from the phosphor so that it can be perceived by the person.

Figure 10:
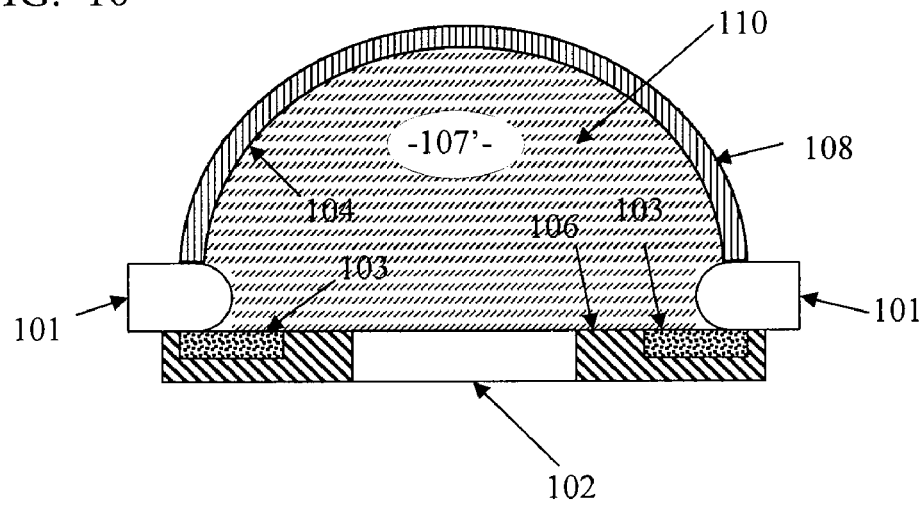
FIG. 10 illustrates an example of yet another white light emitting system with a solid-filled optical cavity, with certain elements thereof shown in cross-section.

FIG. 10 is a simplified diagram illustrating another constructive occlusion type implementation of a lighting system similar to FIG. 9, but includes a solid-filled cavity 107'. The system in FIG. 10 includes a control circuit and power source (not shown), similar to those in several of the earlier examples. These elements control the operation and output intensity of each solid state sources 101. The intensities determine the amount of light energy introduced into cavity 107'.

The intensities of light that pumps the phosphor in the coating 103 also determine the amount visible light generated by the excitation of the phosphor. The solid state sources 101 and phosphor material 103 are not directly visible through the optical aperture 102 due to at least their positioning away from aperture 102. Visible light generated by the phosphor excitation reflects one or more times before being emitted.

In the example, a hemispherical dome 108 and a substantially flat cover plate 106 form around solid-filled optical cavity 107'. The dome and plate may be formed as an integral unit or separately. At least the interior facing surface 104 of the dome 108 and the interior facing surface 103 of the cover plate are highly diffusely reflective, so that the resulting cavity 107 is highly diffusely reflective with respect to the electromagnetic energy spectrum produced by the system. As a result the solid-filled cavity 107' is an integrating type optical cavity. The material forming the inner surface 103, is applied as a coating on a surface of flat cover plate 106, with the coating containing one or more remote phosphors, so that the impact of some of the energy on the surfaces causes emission of visible light of additional desired color(s). At least some electromagnetic energy of the first wavelength, emitted from the energy source packages 101, impacts on the reflective surfaces 104, 106 and the phosphor coating 103. Excitation of the phosphor in the coating 103 causes it to emit visible light. The emitted light comprises visible light energy of at least one second wavelength different from the first wavelength. At least some of visible light emitted by the phosphor is reflected. The lighting system in FIG. 10 directs at least the visible light from the phosphor so that it can be perceived by the person.

Hence, the exemplary fixture in FIG. 10 uses a structure forming a substantially hemispherical optical cavity 107'. When viewed in cross-section, the light transmissive structure therefore appears as approximately a half-circle. This shape is preferred for ease of modeling, but actual products may use somewhat different shapes for the contoured portion. For example, the contour may correspond in cross section to a segment of a circle less than a half circle or extend somewhat further and correspond in cross section to a segment of a circle larger than a half circle. Materials containing phosphors may be provided within or around the solid 110 so long as they are completely occluded. In the example of FIG. 10 the solid 110 is a single integral piece of light transmissive material. The material, for example, may be a highly transmissive and/or low absorption acrylic having the desired shape. In this first example, the light transmissive solid structure 110 is formed of an appropriate glass.

The glass used for the solid of structure 110 in the exemplary fixture 1 of FIG. 10 is at least a BK7 grade or optical quality of glass, or equivalent. For optical efficiency, it is desirable for the solid structure 110, in this case the glass, to have a high transmissivity with respect to light of the relevant wavelengths processed within the optical cavity 107' and/or a low level of light absorption with respect to light of such wavelengths. For example, in an implementation using BK7 or better optical quality of glass, the highly transmissive glass exhibits 0.99 internal transmittance or better (BK7 exhibits a 0.992 internal transmittance).

Exemplary solid-filled optical cavities are described in copending U.S. patent application Ser. No. 12/434,248, which was filed on May 1, 2009, entitled Heat Sinking And Flexible Circuit Board, For Solid State Light Fixture Utilizing An Optical Cavity, the disclosure of which is incorporated herein by reference in its entirety.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present concepts.

What is claimed is:

1. A lighting system, for a visible light illumination application in a region or area to be inhabited by a person, the lighting system comprising:

a semiconductor device comprising a semiconductor chip for emitting electromagnetic energy and a package enclosing the semiconductor chip;

a macro optic outside and coupled to the package enclosing the semiconductor chip, the macro optic receiving the electromagnetic energy emitted from the semiconductor device, the macro optic comprising a macro reflector and a macro mask with a reflective surface;

at least one optical aperture for emission of light out of the macro optic to facilitate the visible light illumination application in the region or area to be inhabited by the person;

the macro mask: being outside the package enclosing the semiconductor chip and separate from macro reflector, and having at least one remote phosphor extending over at least a portion of the reflective surface of the macro mask, wherein:

all of the remote phosphor in the lighting system is occluded by way of the macro mask, such that none of the remote phosphor extending over the portion of the macro mask is directly visible through the optical aperture by the person, the at least one phosphor is responsive to electromagnetic energy from the semiconductor device to emit visible light for the emission through the at least one optical aperture, and no remote phosphor in the lighting system is directly visible through the optical aperture.

2. The lighting system according to claim 1, wherein:

a first wavelength of the electromagnetic energy from the semiconductor device excites the at least one remote phosphor to emit visible light, comprising visible light energy of at least one second wavelength different from the first wavelength, at least some of visible light emitted by the at least one remote phosphor is reflected by the macro optic, and the lighting system directs at least the visible light emitted by the at least one remote phosphor so that it can be perceived by the person when present in the region or area to be inhabited.

3. The lighting system according to claim 1, wherein the at least one remote phosphor comprises one or more quantum dot (Q-dot) phosphors or doped semiconductor nanophosphors.

4. The lighting system according to claim 3, wherein the Q-dot phosphors include one or more doped nano-crystal dot phosphors.

5. The lighting system according to claim 1, the macro optic further comprising:

a diffuse macro reflector forming an optical integrating cavity for optically integrating visible light produced by excitation of the at least one remote phosphor extending over the surface of the macro mask.

6. The lighting system of claim 1, wherein the semiconductor device comprises a semiconductor device for emitting at least some ultraviolet (UV) radiation.

7. The lighting system of claim 1, wherein the semiconductor device comprises a semiconductor device for emitting at least some blue light.

8. The lighting system of claim 1, wherein the semiconductor device comprises a semiconductor device for emitting at least some white light.

9. The lighting system of claim 1, further comprising:

a deflector having a reflective inner surface for directing visible light into a narrow field of view; and a plurality of semiconductor devices, wherein the plurality of semiconductor devices emit electromagnetic energy of the first wavelength, wherein each of the semiconductors is enclosed within its own package, wherein the plurality of semiconductor devices are light emitting diodes (LEDs).

10. The lighting system according to claim 9, wherein the plurality of semiconductor devices are selected from among white, blue, ultraviolet (UV) or near UV LEDs.

11. The lighting system according to claim 1, wherein:

the at least one remote phosphor extends over an output of the semiconductor device, and the semiconductor device is occluded such that the semiconductor device is not directly visible through the optical aperture by the person.

12. The lighting system according to claim 9, wherein:

the at least one remote phosphor extends over a surface of each of the plurality of the semiconductor devices, and each semiconductor device is occluded such that none of the semiconductor devices are directly visible through the optical aperture by the person.

13. A lighting system, for a visible light illumination application in a region or area to be inhabited by a person, the lighting system comprising:

a plurality of semiconductor devices, each semiconductor device including a semiconductor chip for emitting electromagnetic energy and a package enclosing each semiconductor chip;

a diffuse macro reflector outside and coupled to the packages enclosing the semiconductor chips, the diffuse macro reflector forming an optical cavity and configured to receive electromagnetic energy emitted from the plurality of semiconductor devices;

at least one optical aperture for emission of light out of the cavity to facilitate the visible light illumination application in the region or area to be inhabited by the person;

a macro mask with a reflective surface for occluding a portion of the at least one optical aperture, the macro mask disposed outside the packages enclosing the semiconductor chips and separate from the diffuse macro reflector; and at least one remote phosphor being occluded by way of the macro mask and extending over at least a portion of the reflective surface of the macro mask at a location such that all of the remote phosphor in the lighting system is occluded by way of the macro mask and none of the remote phosphor extending over the macro mask is directly visible through the optical aperture by the person, wherein:

the at least one phosphor is responsive to electromagnetic energy from the semiconductor device to emit visible light for the emission through the at least one optical aperture, and no remote phosphor in the lighting system is directly visible through the optical aperture.

14. The lighting system according to claim 13, wherein the at least one remote phosphor comprises one or more quantum dot (Q-dot) phosphors or doped semiconductor nanophosphors.

15. The lighting system according to claim 14, wherein the Q-dot phosphors include one or more doped nano-crystal dot phosphors.

16. The lighting system of claim 13, wherein one or more of the semiconductor devices comprises a semiconductor device for emitting at least some ultraviolet (UV) radiation.

17. The lighting system of claim 13, wherein one or more of the semiconductor devices comprises a semiconductor device for emitting at least some blue light.

18. The lighting system of claim 13, wherein one or more of the semiconductor devices comprises a semiconductor device for emitting at least some white light.

19. The lighting system according to claim 13, wherein the plurality of semiconductor devices are light emitting diodes (LEDs) selected from among white, blue, ultraviolet (UV), and near UV LEDs.

* * * * *